US007557764B2

(12) United States Patent
Krajicek

(10) Patent No.: US 7,557,764 B2
(45) Date of Patent: Jul. 7, 2009

(54) MEANS FOR MOUNTING A PORTABLE SATELLITE ANTENNA ON A VEHICLE

(76) Inventor: William F. Krajicek, 14112 S. 63rd St., Omaha, NE (US) 68133

( * ) Notice: Subject to any disclaimer, the term of this patent is extended or adjusted under 35 U.S.C. 154(b) by 0 days.

(21) Appl. No.: 11/974,145

(22) Filed: Oct. 11, 2007

(65) Prior Publication Data

US 2009/0096689 A1 Apr. 16, 2009

(51) Int. Cl.
*H01Q 1/34* (2006.01)

(52) U.S. Cl. ..... 343/713; 343/880

(58) Field of Classification Search ..... 343/711, 343/713, 878, 880

See application file for complete search history.

(56) References Cited

U.S. PATENT DOCUMENTS

| | | | | |
|---|---|---|---|---|
| 4,663,633 | A | 5/1987 | Wilson | |
| 4,725,843 | A | 2/1988 | Suzuki et al. | |
| 5,526,010 | A | 6/1996 | Plunk | |
| 5,554,998 | A | 9/1996 | Sherwood et al. | |
| 5,576,722 | A | 11/1996 | Bustillos | |
| 5,886,673 | A | 3/1999 | Thomas | |
| 5,961,092 | A | 10/1999 | Coffield | |
| 5,977,922 | A | 11/1999 | Hemmingsen, II | |
| 6,638,000 | B2 * | 10/2003 | Groves | 414/462 |
| 6,657,589 | B2 | 12/2003 | Wang et al. | |
| 6,734,830 | B1 | 5/2004 | Bickham | |
| 6,814,383 | B2 | 11/2004 | Reed, III et al. | |
| 7,271,773 | B2 | 9/2007 | Gorai et al. | |
| 2005/0146483 | A1 | 7/2005 | Levasseur | |

* cited by examiner

*Primary Examiner*—Don P Le
(74) *Attorney, Agent, or Firm*—Dennis L. Thomte; Thomte Patent Law Office LLC

(57) ABSTRACT

Several different embodiments are illustrated for attaching, supporting or mounting a portable satellite antenna on a vehicle or supported by the vehicle. In two of the embodiments, the satellite antenna is secured to the roof rack of the vehicle. In a third embodiment, the satellite antenna is secured to the upper ends of the sides of a pickup truck. Alternative methods for mounting or supporting the portable satellite antenna are also disclosed.

12 Claims, 12 Drawing Sheets

MEANS FOR MOUNTING A PORTABLE SATELLITE ANTENNA ON A VEHICLE

BACKGROUND OF THE INVENTION

1. Field of the Invention

This invention relates to a means for mounting a portable satellite antenna on a vehicle and more particularly to a means for mounting a portable satellite antenna on the roof rack of a vehicle or on the sides of the box of a pick-up truck. This invention further relates to an antenna supporting structure which is stabilized by a tire of a vehicle.

2. Description of the Related Art

Many ways of mounting a portable satellite antenna have been previously provided but it is not believed that any of the previous devices enable a portable satellite antenna to be quickly and easily mounted on the roof rack of a vehicle or on the box of a pick-up truck. In any device for mounting a portable satellite antenna on a vehicle, a problem encountered is that the vehicle will not always be perfectly level with the result being that the mast of the satellite antenna will not be plumb. It is important to be sure that the mast is level or plumb in any installation. If it is not plumb, the elevation setting of the antenna will be incorrect. Further, the problem encountered in the mounting of a portable satellite antenna on a vehicle is that the antenna does not interfere with the normal use of the vehicle which is extremely important when the vehicle is being used for tailgating functions or the like. A further problem encountered in the mounting of a portable satellite antenna on a vehicle is that the vehicle must not interfere with the reception of the satellite signal by the antenna.

SUMMARY OF THE INVENTION

Four different methods of mounting or supporting a portable satellite antenna on a vehicle are disclosed with two of the methods enabling the portable satellite antenna to be mounted on the roof rack of a vehicle with the third method enabling the portable satellite antenna to be mounted on the box of a pick-up truck. The fourth method of supporting the satellite antenna includes a tire of the vehicle. In the first mounting method, the mounting structure for the antenna is secured to and is extended between the longitudinally extending side rails of the roof rack. In the second method, the mounting structure for the antenna is secured to and extends between a pair of transversely extending rack members which are selectively slidably mounted on the side rails of the roof rack. In the third method, the mounting structure is secured to and is extended between the upper ends of the side walls of the box of the pick-up truck. In the fourth method, a tire of a vehicle is positioned upon a base plate with a mast or pole extending upwardly therefrom upon which the antenna is adjustably mounted.

In the first three installations, a vertically disposed tubular member is connected to an adjustable base plate with the base plate being secured to the upper end of a swivel with the lower end of the swivel being secured to a fixed plate positioned below the base plate with the fixed plate being secured to a mounting structure. A bubble level is provided on the base plate so that the tubular member may be oriented in a plumb condition regardless of the attitude or levelness of the vehicle. The mast of the satellite antenna is slipped over the upstanding tubular member and is held in place by means of a locking bolt or stud. Preferably, a compass is also provided on the upper surface of the base plate to aid a person in rotating the mast with respect to the tubular member so that the proper azimuth alignment of the antenna is achieved. The fourth installation also includes the adjustable mounting structure so that the proper azimuth alignment of the antenna is achieved. A fourth structure is also described for mounting the antenna on a picnic table or the like. Yet another structure is disclosed for mounting a flag on the roof rack of the vehicle.

It is therefore a principal object of the invention to provide novel means for mounting or supporting a portable satellite antenna on or with a vehicle.

A further object of the invention is to provide a means for mounting a portable satellite antenna on the roof rack of a vehicle.

Yet another object of the invention is to provide a means for mounting a portable satellite antenna on the upper ends of the side walls of a pick-up truck box.

A further object of the invention is to provide a mounting means for a portable satellite antenna including means for quickly and easily plumbing a supporting tube so that the mast of the antenna when placed thereon will be plumb.

Yet another object of the invention is to provide a means for mounting a portable satellite antenna on a vehicle which is quickly and easily mounted thereon.

These and other objects will be apparent to those skilled in the art.

BRIEF DESCRIPTION OF THE DRAWINGS

FIG. 11 is a partial perspective view of illustrating an embodiment wherein the antenna mounting structure is secured to a picnic table or the like.

DETAILED DESCRIPTION OF THE INVENTION

Figure 1:
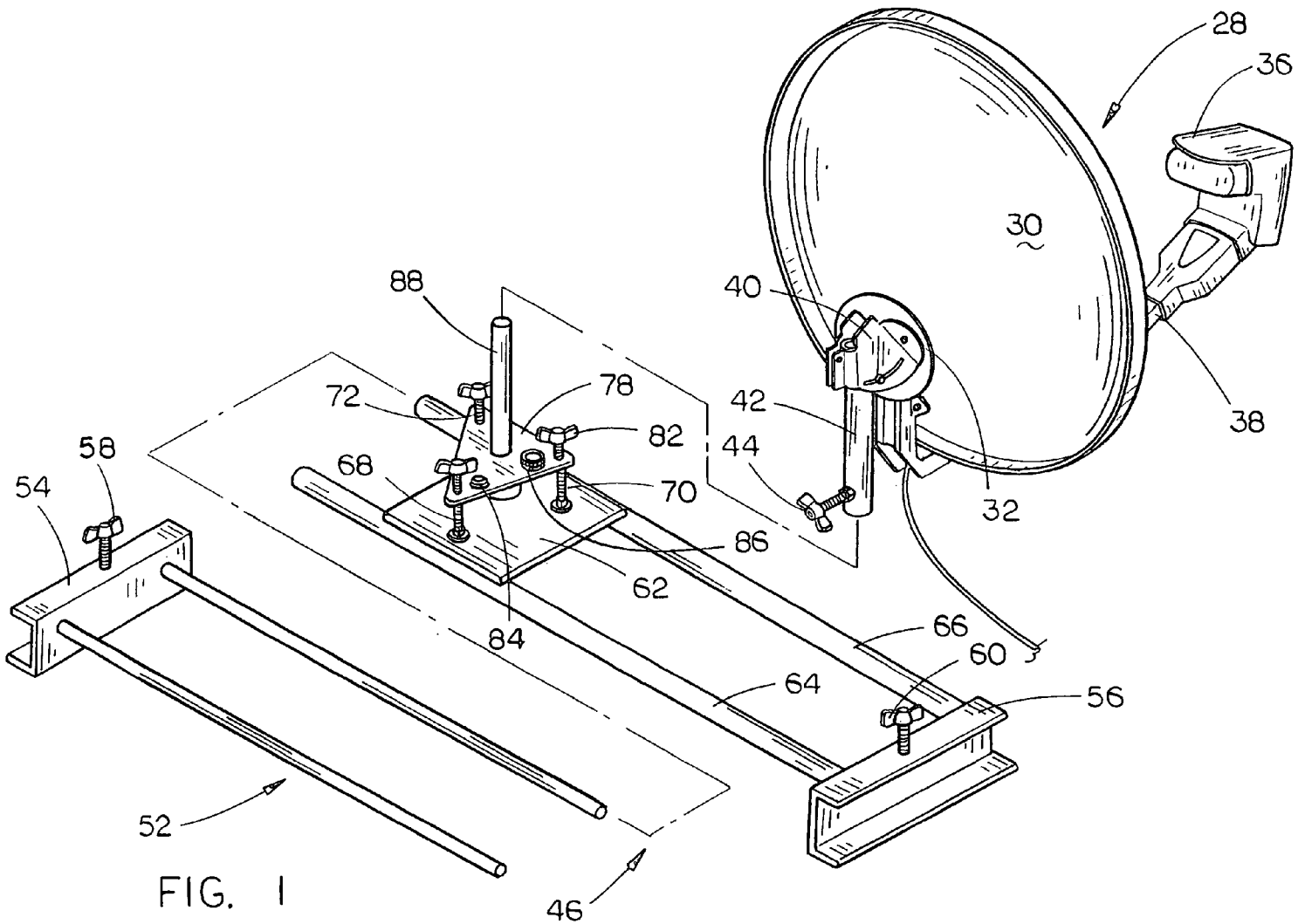
FIG. 1 is an exploded perspective view of one embodiment of the means for mounting a portable satellite antenna on a vehicle.
Figure 2:
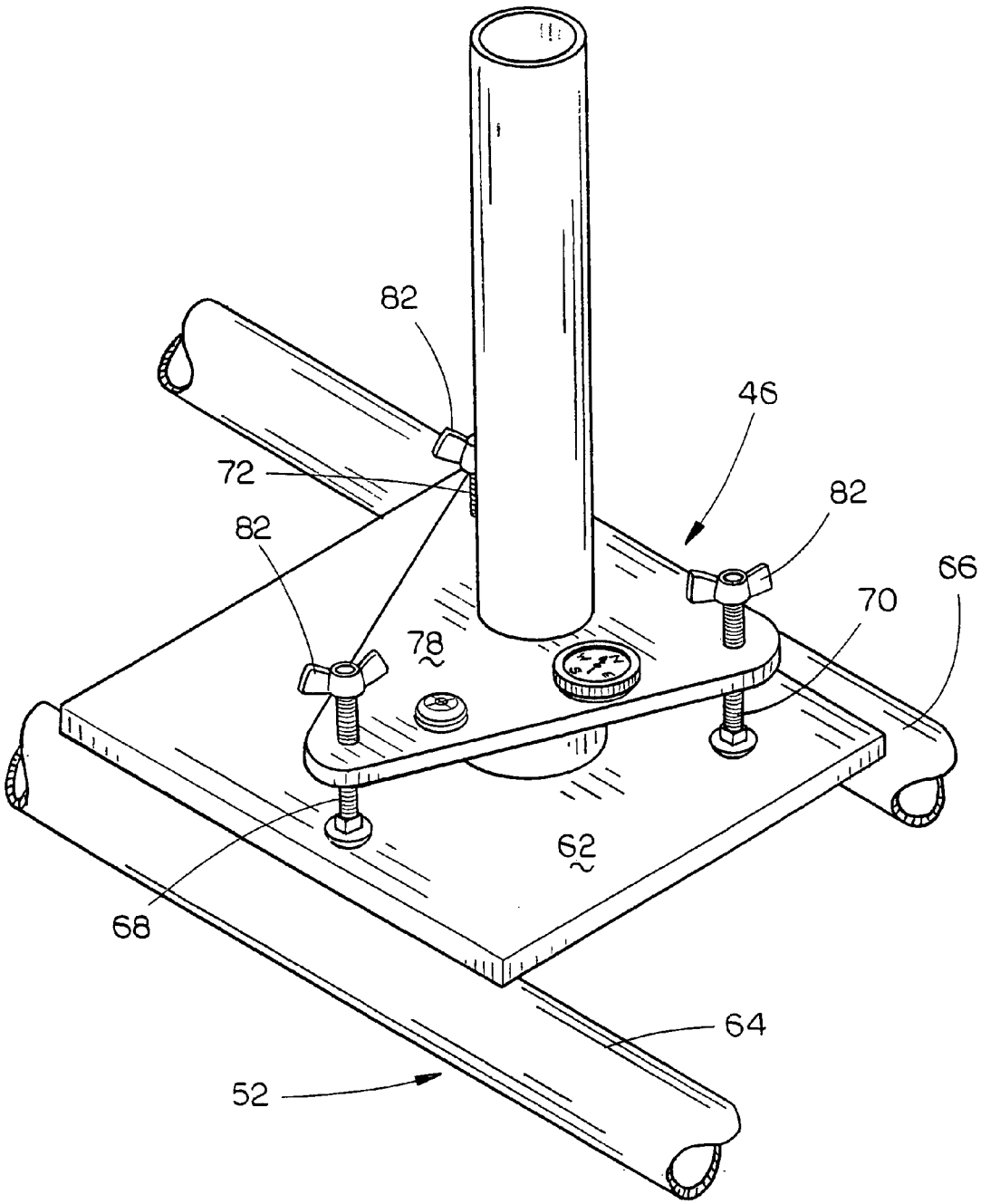
FIG. 2 is a partial perspective view of the embodiment shown in FIG. 2.

In the drawings, the numeral 10 refers to vehicle such a van, SUV or the like which has a roof rack 12 mounted thereon. Roof rack 12 normally includes a pair of longitudinally and horizontally spaced apart side rack members or rails 14 and 16 and which has two or more transversely extending rack members or rails 18 and 20 slidably adjustably mounted on the rails 14 and 16.

Figure 6:
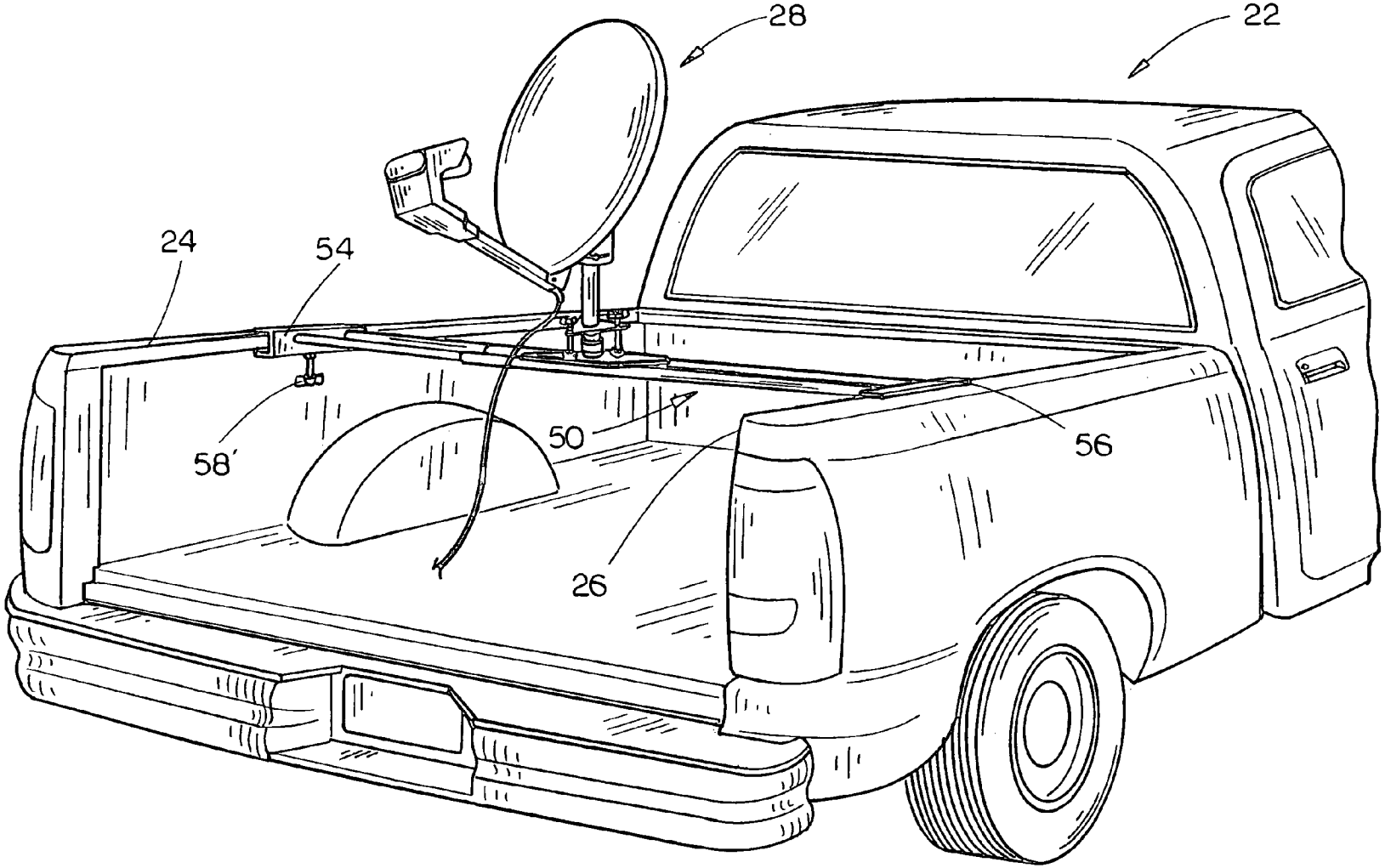
FIG. 6 is a rear perspective view illustrating the means for mounting a portable satellite antenna on the sides of a pickup truck.
Figure 7:
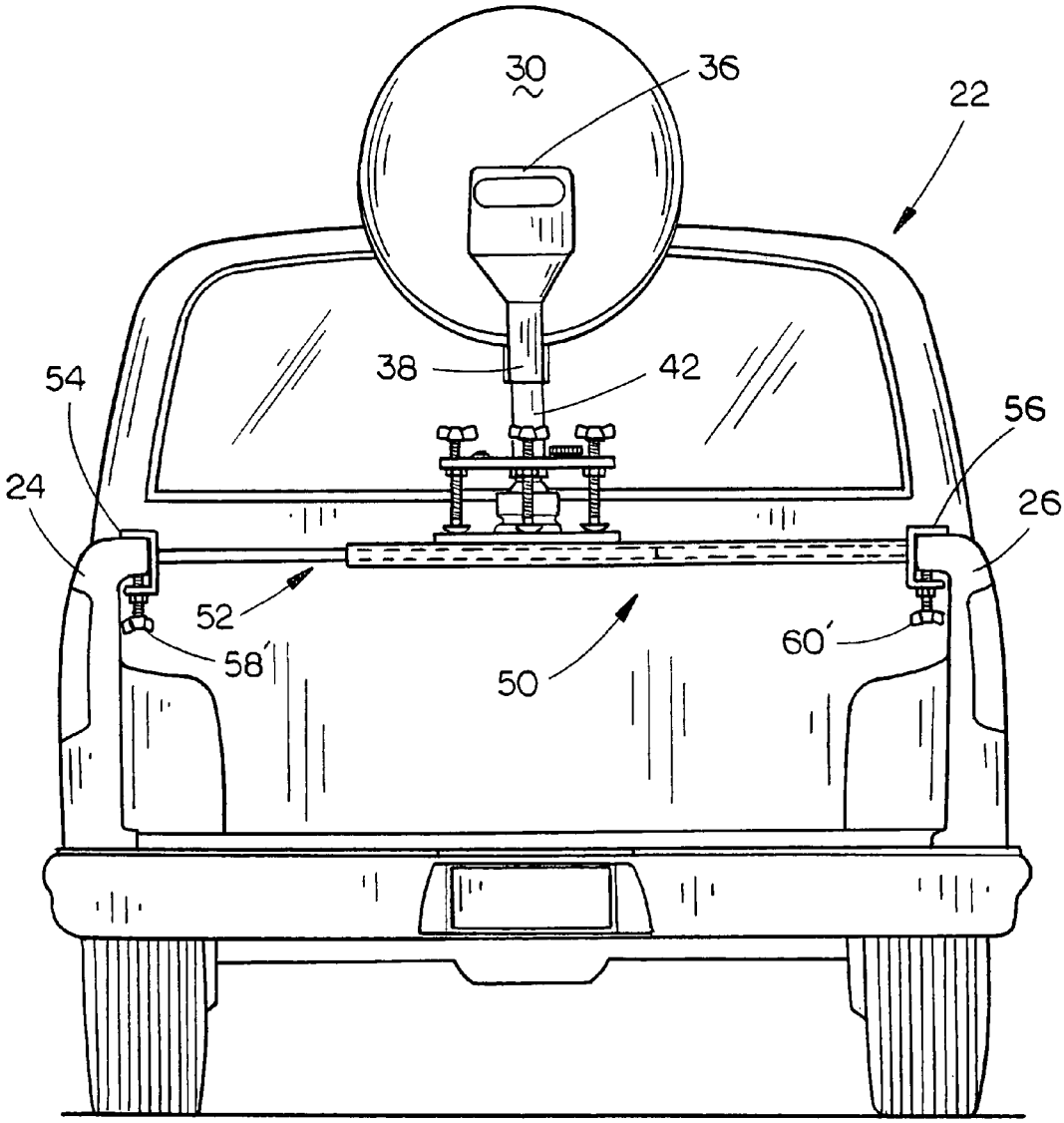
FIG. 7 is a rear view of the structure shown in FIG. 6.
Figure 8:
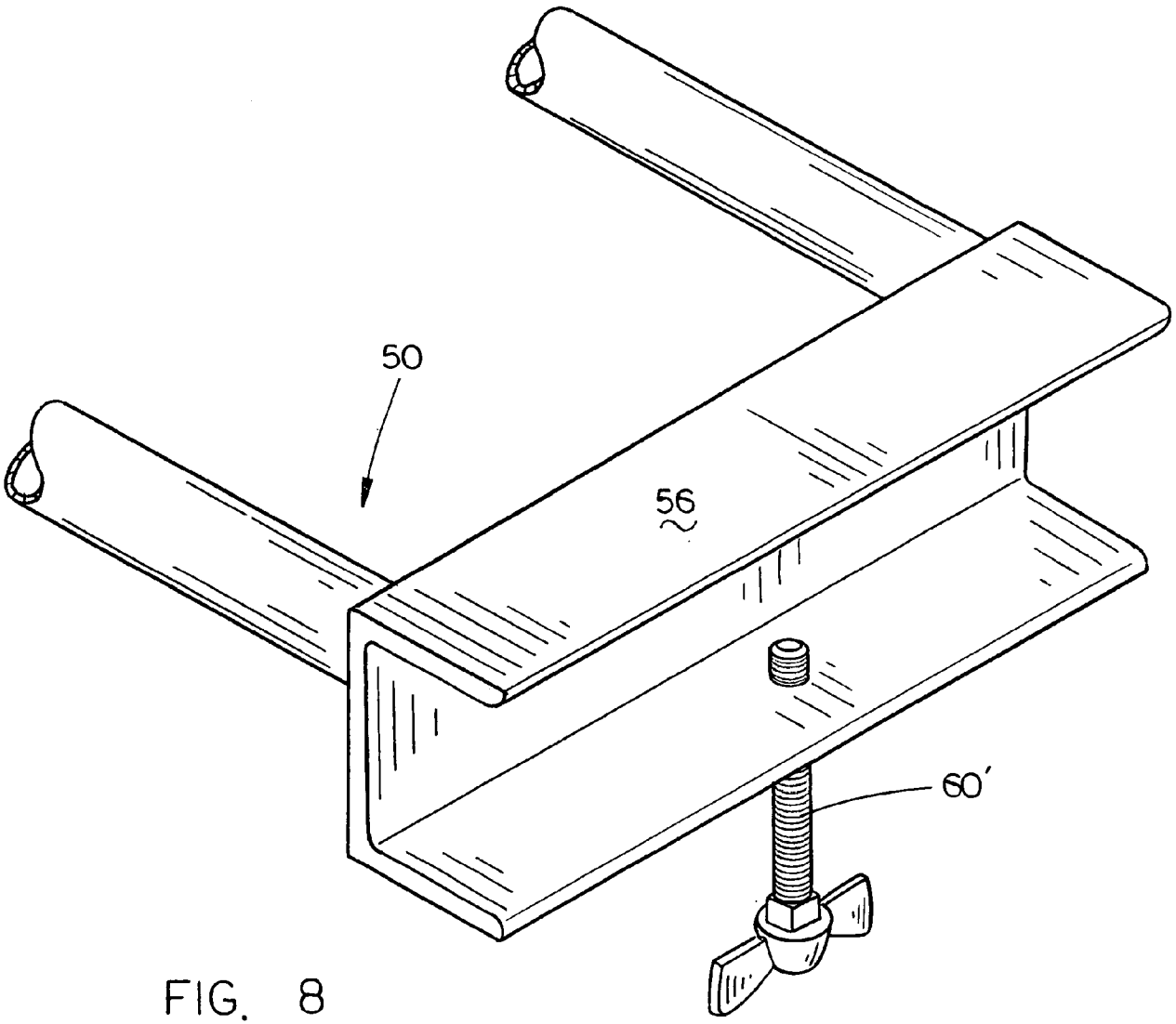
FIG. 8 is a partial perspective view of one end of the mounting structure which secures the mounting structure to the pickup truck of FIG. 7.

In FIGS. 6 and 7, the numeral 22 refers to a pick-up truck having a box or bed which includes upstanding side walls 24 and 26 having upper ends.

In the drawings, the numeral 28 refers to a conventional satellite antenna including a reflector or dish 30, reflector support 32, LNB horn 36, and an LNB support arm 38 extending therefrom to the mounting bracket assembly 40 of the antenna 28. The mounting bracket assembly 40 includes conventional means for adjusting the elevation of the reflector 30 and means for adjusting the skew of the reflector 30. Normally, a mast extends from the mounting bracket assembly 40 for connection to another mounting bracket which may be secured to a post, building, etc. In this case, the conventional mast has been replaced by a tubular mast member referred to generally by the reference numeral 42. A threaded bolt extends inwardly in to the mast member 42 and is referred to generally by the reference numeral 44.

The numeral 46 refers to the first mounting means of this invention while the numeral 48 refers to the second mounting means of this invention with the numeral 50 referring to the third mounting means of this invention. A mounting means 51 is also described for supporting the satellite antenna with the tire of a vehicle.

Figure 4:
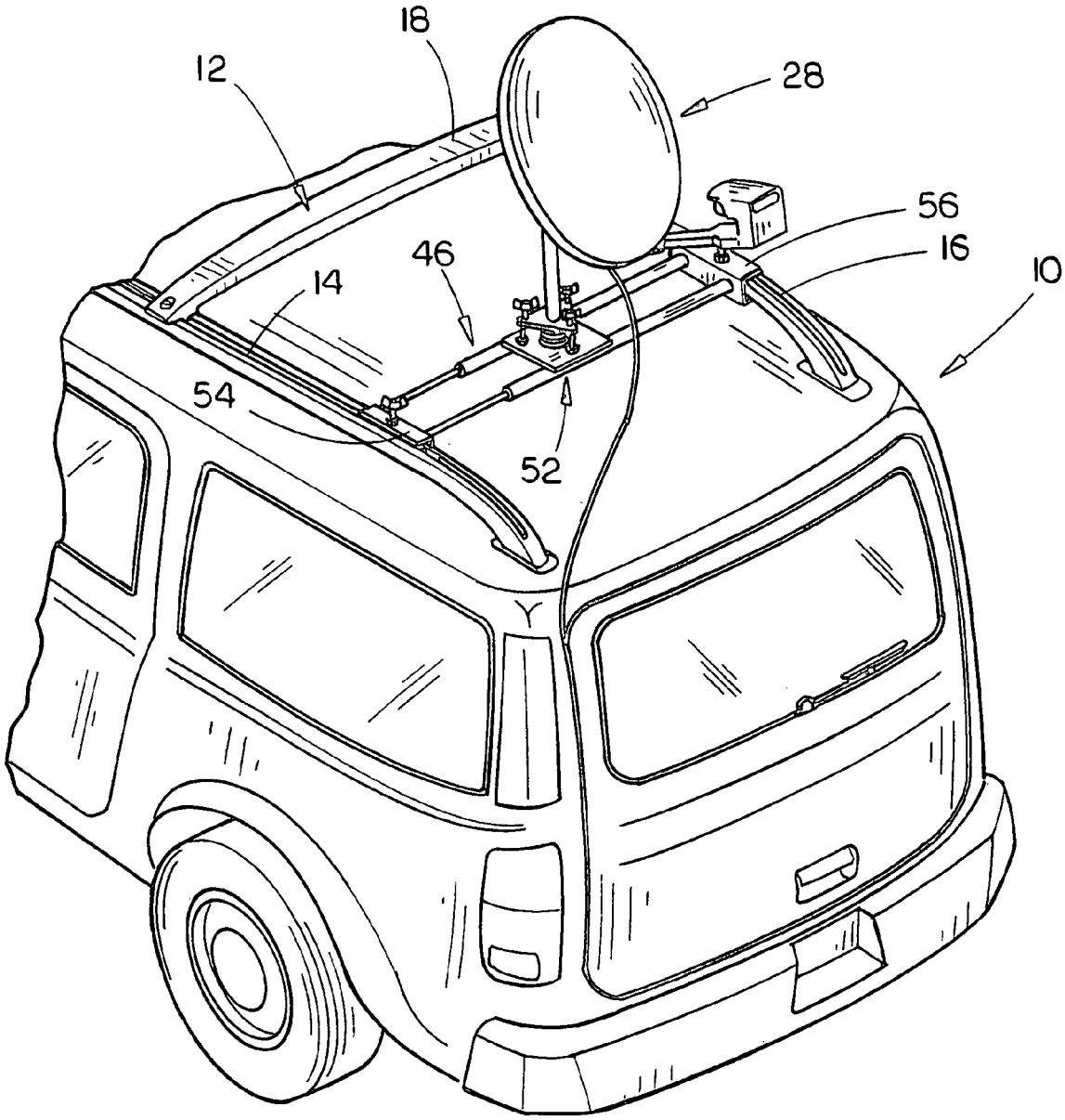
FIG. 4 is a rear perspective view of a vehicle having a satellite antenna mounted on the roof rack of a vehicle by way of the embodiment of FIG. 1.
Figure 5:
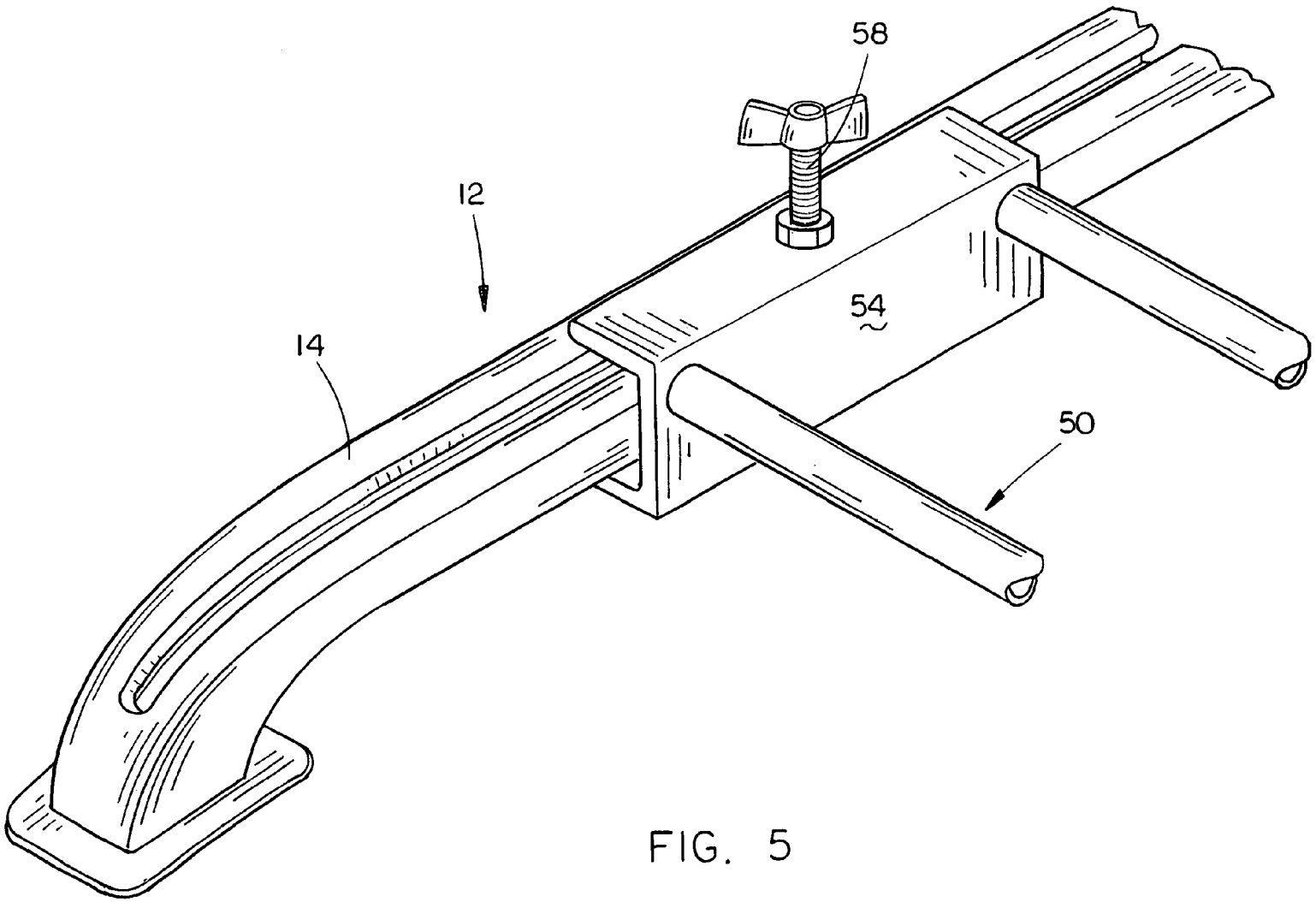
FIG. 5 is a partial perspective view of the roof rack of the vehicle of FIG. 4 and the mounting structure of FIG. 4.

Mounting means 46 includes a support structure 52 which is length adjustable and which has brackets or connectors 54 and 56 secured to the outer ends thereof. The brackets or connectors 54 and 56 are secured to the side rails 14 and 16 of the roof rack 12 of the vehicle, as seen in FIG. 4. As seen, the brackets 54 and 56 are C-shaped in cross section and are adapted to receive the inner sides of the rails 14 and 16. Locking bolts 58 and 60 extend downwardly through the brackets 54 and 56 respectively for engagement with the upper surface of the rails 14 and 16 respectively to hold the support structure 52 in place.

Plate 62 is secured to and extends between the support members 64 and 66 of support structure 52 by welding or the like and is adapted to rotatably support the lower ends of three adjustment bolts 68, 70 and 72 which extend upwardly therefrom.

A collar 74 is welded to plate 62 and receives the lower end of swivel ball assembly 76 therein. The upper end of the swivel ball assembly 76 is welded to plate 78 which is adjustably positioned above plate 62. Three lock nuts 80 are welded to the underside of plate 78 and threadably receive the adjustment bolts 68, 70 and 72 therein. The upper ends of the bolts 68, 70 and 72 each have a wing nut 82 welded thereto.

Figure 3:
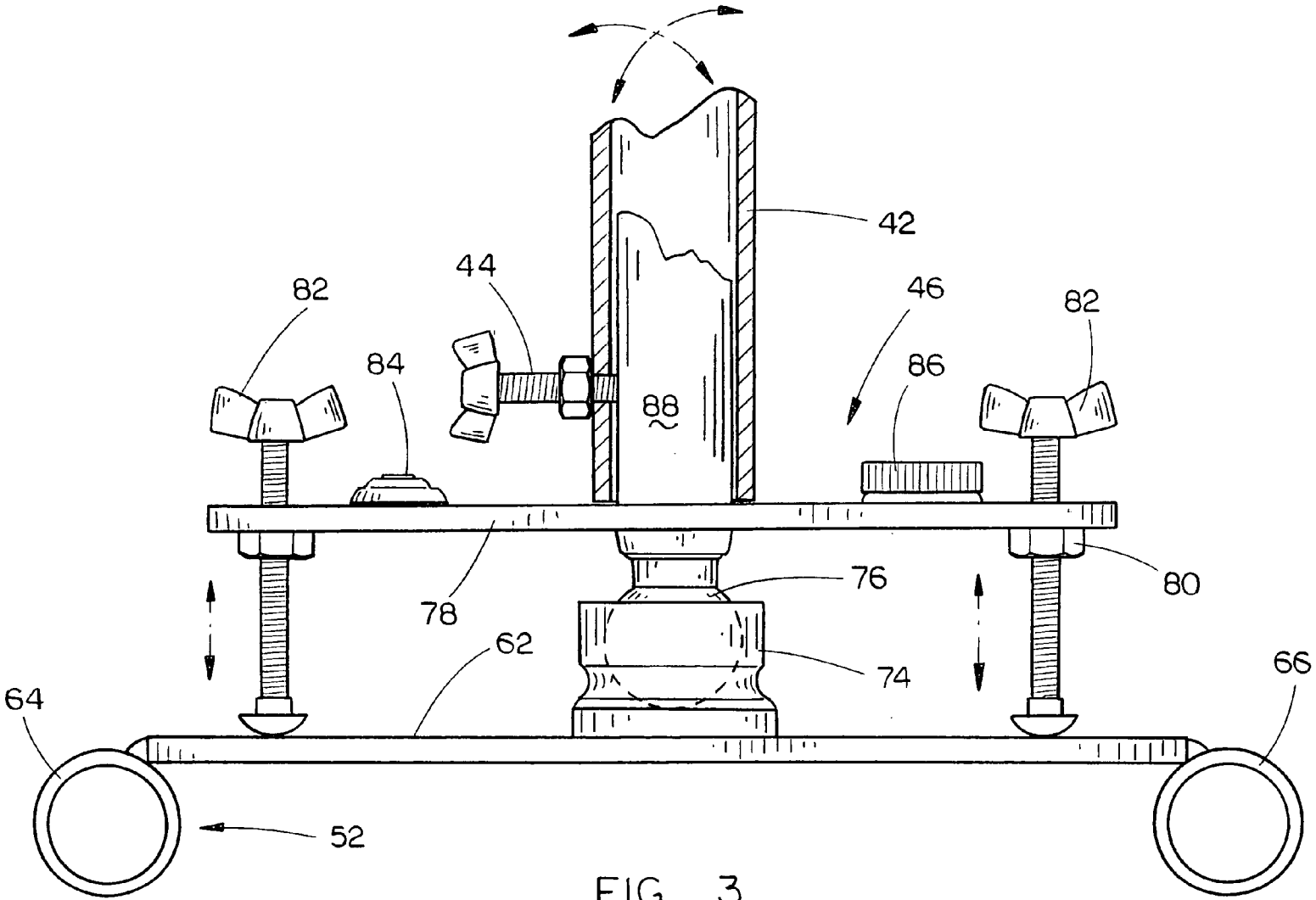
FIG. 3 is a side view of the structure of FIG. 2 with portions thereof cut away to more fully illustrate the invention.

The upper surface of plate 78 is provided with a bubble level 84 and is also provided with a compass 86. A tubular support 88 has its lower end secured to the center of plate 78 by any convenient means and extends upwardly therefrom. The tubular support 88 is adapted to be selectively rotatably received by the lower end of mast member 42, as seen in FIG. 3.

The length adjustable support structure 52 is positioned between the rails 14 and 16 of the roof rack 12 and adjusted until the brackets 54 and 56 receive the rails 14 and 16, as seen in FIG. 4. The locking bolts 58 and 60 are then threadably rotated until the lower ends thereof engage the rails 14 and 16 to maintain the support structure 52 and the mounting means 46 in place on the roof rack 12. The vehicle may be driven to the desired location for tailgating, picnics, etc. At that time, the adjustment bolts 68, 70 and 72 are adjusted so that plate 78 is level and the tubular support 88 is plumb, as indicated by the bubble level 84. The antenna 28 may then be mounted on the tubular support 88 by lowering the mast member 42 onto the support 88. The antenna may then be rotated with respect to support 88 until the antenna is aimed along the proper azimuth as indicated by the compass 86. The locking bolt 44 is then tightened to maintain the antenna 28 in position. The azimuth, elevation and skew of the antenna is determined by way of a look up table based on the zip code of the location of the vehicle. The fact that the tubular support 88 is plumb, regardless of the levelness of the vehicle, ensures that the elevation and skew of the receiver will be accurate which is not possible if the tubular support 88 and mast member 42 are not plumb.

The television in the vehicle or adjacent the vehicle may then be turned on to enhance the tailgating and/or picnic activities.

Figure 10:
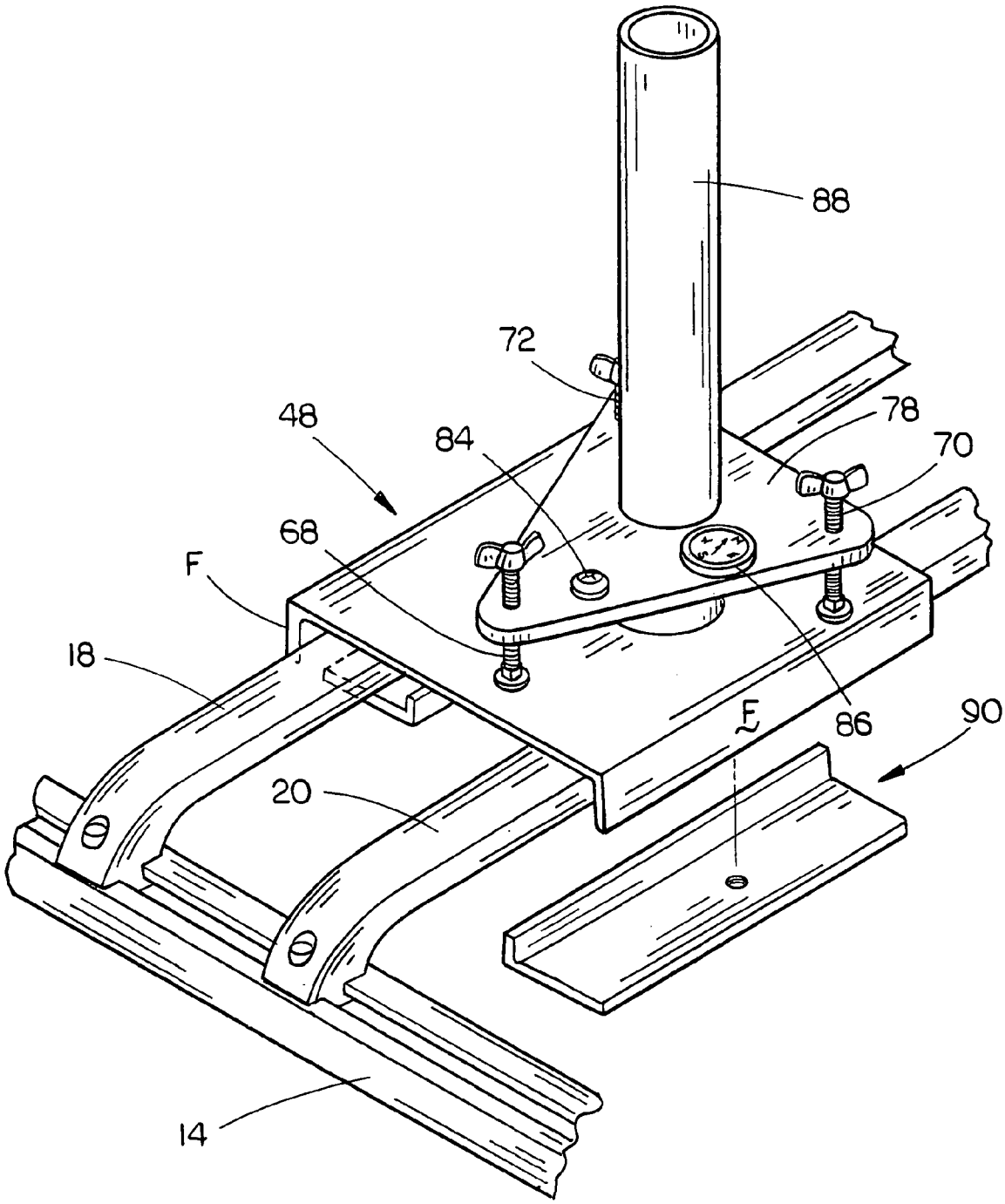
FIG. 10 is a partial perspective view illustrating another embodiment for mounting a portable satellite antenna on the roof rack of a vehicle.

The mounting means 48 is quite similar to the mounting means 46 except it is positioned between the transversely extending rails 18 and 20 and clamped thereto, as illustrated in FIG. 10, rather than being extended between the rails 14 and 16 and secured thereto. As seen in FIG. 10, the mounting means 48 includes a clamping structure 90 which is clamped onto the rails 18 and 20. The remaining structure on mounting means 48 is identical to mounting means 46 except that the plate 78 has downwardly extending flanges F.

The mounting means 50 is almost identical to mounting means 46 except that the brackets 54 and 56 are secured to the upper ends of the side walls 24 and 26 of the pickup truck 22 and that the locking bolts 58' and 60' extend downwardly through the brackets 54 and 56 rather than upwardly through the brackets 54 and 56, respectively. The positioning of the bolts 58' and 60' in mounting means 50 is merely to avoid upwardly extending protrusions which might be a nuisance.

Figure 9:
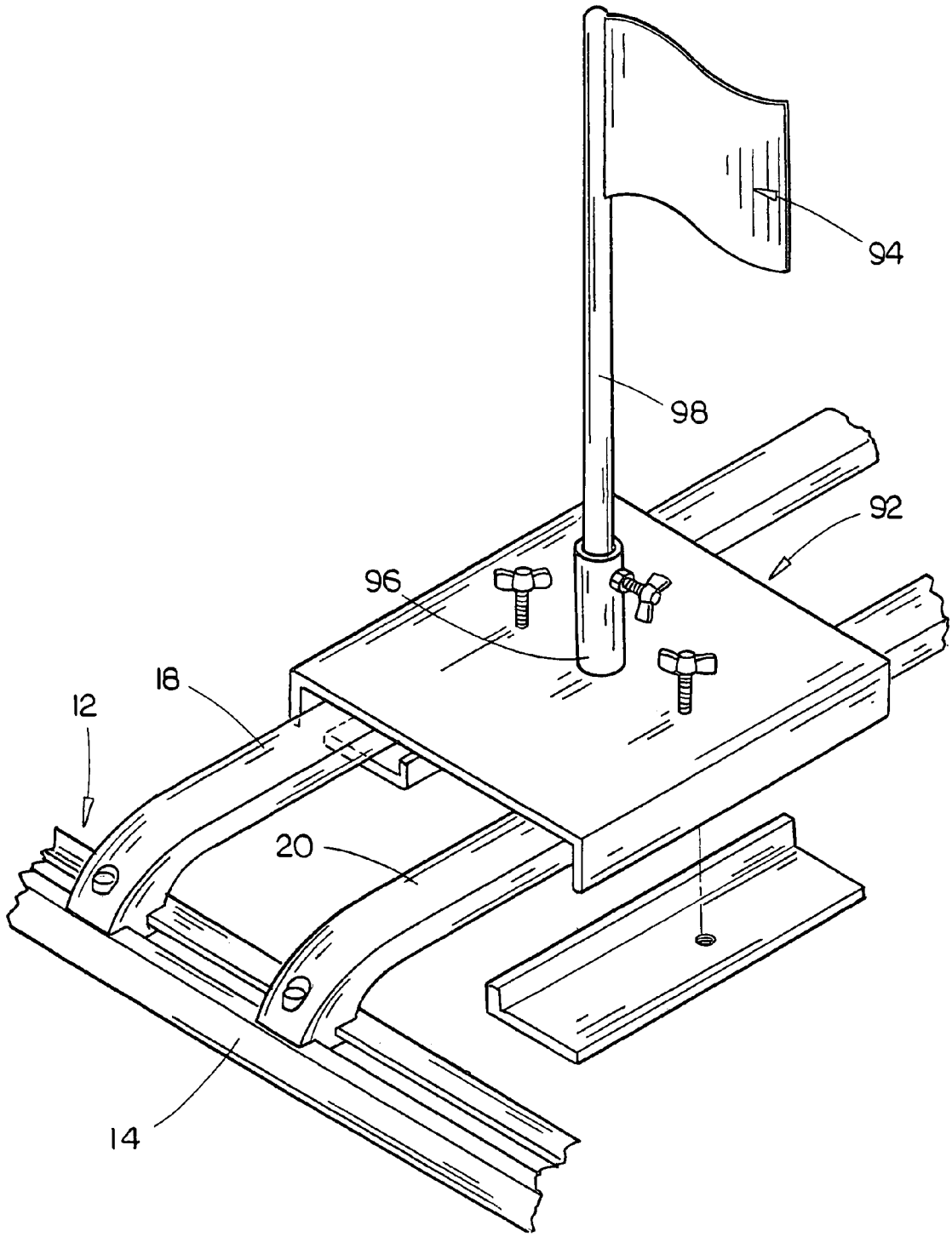
FIG. 9 is a partial perspective view of a means for mounting a flag on the roof rack of the vehicle.

FIG. 9 illustrates a mounting structure 92 for a flag 94 which may be clamped onto rails 18 and 20 of rack 12. Structure 92 includes a tubular support 96 which extends upwardly from mounting structure 92 which is adapted to receive the pole 98 of the flag 94.

Figure 11:
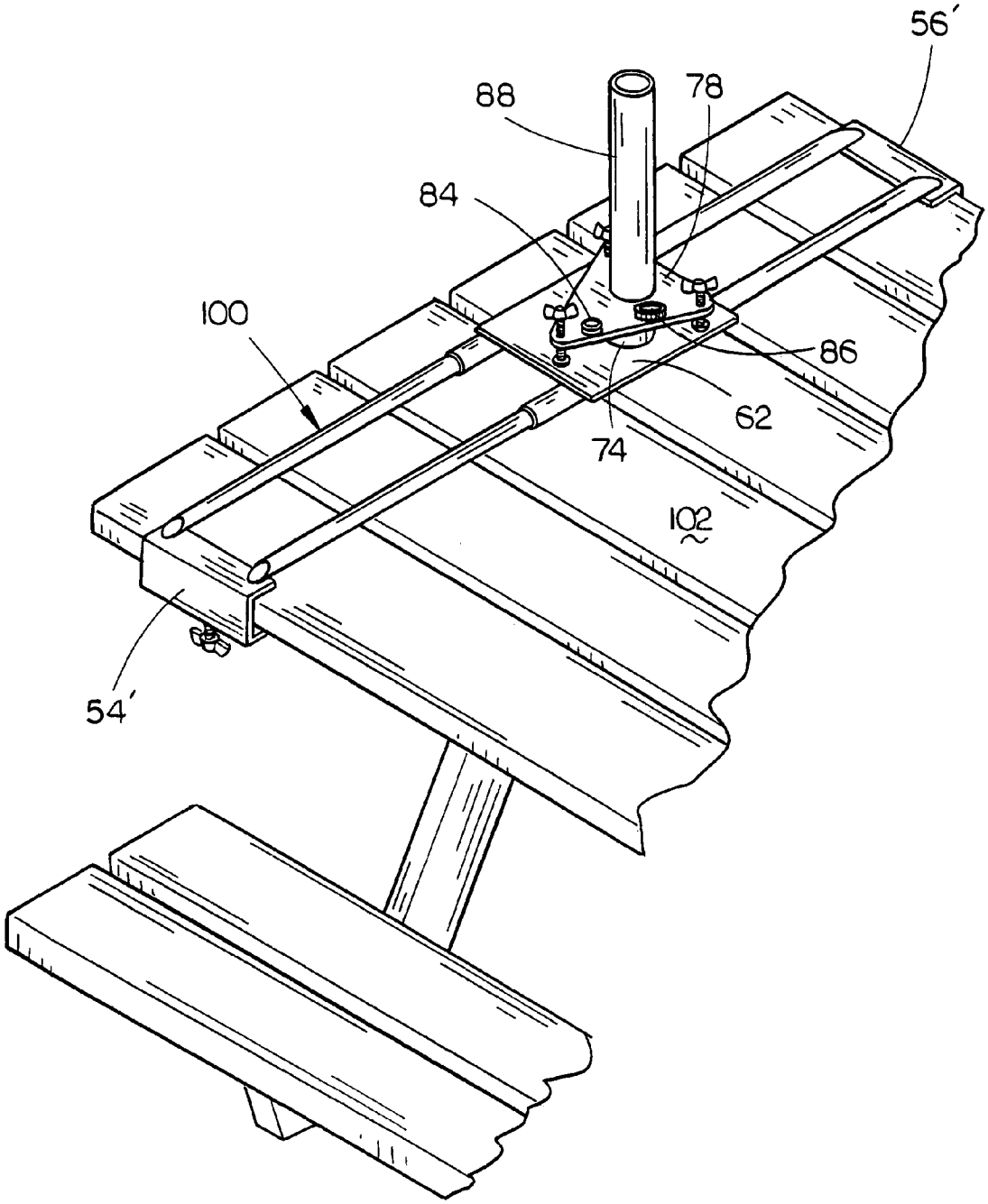

FIG. 11 illustrates a mounting structure 100 which is substantially identical to mounting structure 50 except that the brackets 54' and 56' in the FIG. 11 structure corresponding to brackets 54 and 56 in mounting structure 50 face inwardly towards one another so that the brackets 54' and 56' at the opposite ends of structure 100 may receive the side edges of a picnic table 102 or the like and be clamped onto the table 102. The mounting structure 100 is identical to mounting structure 50 in all other aspects.

Figure 12:
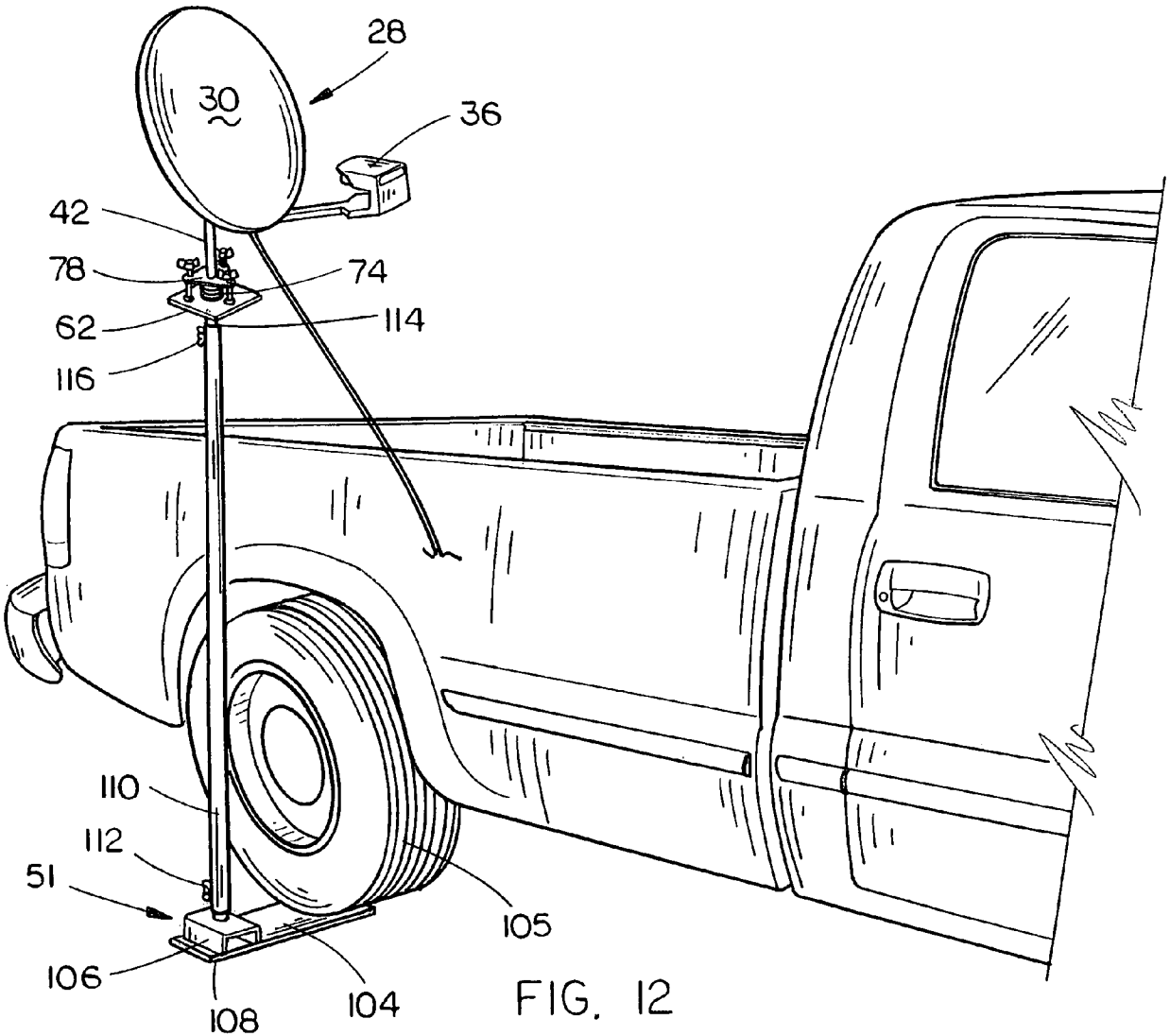
FIG. 12 is a perspective view of illustrating a further means for supporting a satellite antenna structure on a vehicle.

FIG. 12 illustrates a further means for supporting a satellite antenna by a vehicle and which is referred to by the reference numeral 51. In FIG. 12, a rectangular, flat plate 104 is placed on the ground and is adapted to have a vehicle tire or wheel 105 positioned thereon. A support channel 106 is welded to one end of plate 104 and has a tubular support 108 extending upwardly therethrough. Pipe 110 is selectively mounted on tubular support 108 and held in place by locking bolt 112. A tubular support 114 extends downwardly from base plate 62 and which is received by the upper end of pipe 110 and selectively rotatably maintained therein by locking bolt 116. All of the antenna mounting structure above plate 62 is identical to that shown in FIG. 1.

In use, plate 104 is placed on the ground and the vehicle is driven so as to place one of the tires thereof thereon. Pipe 110 is placed on tubular support 108 and locked in place by locking bolt 112. The tubular support 114 and the mounting structure thereabove and the antenna are then mounted on the upper end of pipe 110. The plate 78 is then leveled as described hereinabove so that the tubular support 88 is plumb. The mast member 42 is then rotated until it is aligned on the proper azimuth, at which time the locking bolt 44 is tightened. The weight of the vehicle on the plate 104 stabilizes the antenna 28.

Thus it can be seen that a novel means has been provided for mounting a portable satellite antenna on a vehicle which includes adjustment means to ensure that the mast of the antenna will be plumb. It can also be seen that the means of this invention enables a satellite antenna to be quickly installed on a vehicle and quickly and easily adjusted.

Thus it can be seen that the invention accomplishes at least all of its stated objectives.

I claim:

1. In combination with a pickup-type vehicle having a bed with upstanding first and second side walls having upper ends, comprising:

a first mounting bracket selectively removably secured to the upper end of the first side wall of the vehicle;

a second mounting bracket selectively removably secured to the upper end of the second drive wheel of the vehicle;

an elongated connector, having first and second ends, secured to said first and second mounting brackets and extending therebetween;

a first upstanding support secured to said connector intermediate the ends thereof;

said first upstanding support being selectively adjustable so that it may be positioned in a substantially vertically disposed position regardless of the attitude of the vehicle;

and an adjustable satellite dish mounted on said first upstanding support which may be adjusted with respect to said first support so as to receive signals from a satellite.

2. The combination of claim 1 wherein said satellite dish is selectively rotatably secured to said first support.

3. In combination with a pickup-type vehicle having a bed with upstanding first and second side walls having upper ends, comprising:

a first mounting bracket selectively removably secured to the upper end of the first side wall of the vehicle;

a second mounting bracket selectively removably secured to the upper end of the second drive wheel of the vehicle;

an elongated connector, having first and second ends, secured to said first and second mounting brackets and extending therebetween;

a first upstanding support secured to said connector intermediate the ends thereof;

and a flag secured to said first support.

4. In combination with a vehicle having a roof mounted rack positioned thereon, comprising:

a mounting bracket assembly selectively removably secured to the rack;

a first upstanding support secured to said mounting bracket assembly;

said first upstanding support being selectively adjustable so that it may be positioned in a substantially vertically disposed position regardless of the attitude of the vehicle;

and an adjustable satellite dish mounted on said first upstanding support which may be adjusted with respect to said first support so as to receive signals from a satellite.

5. The combination of claim 4 wherein said satellite dish is selectively rotatably secured to said first support.

6. The combination of claim 4 wherein the roof mounted rack includes first and second longitudinally extending side rails and wherein said mounting bracket assembly is selectively removably secured to said first and second side rails and extends therebetween.

7. The combination of claim 4 wherein the roof mounted rack includes first and second longitudinally extending side rails and a pair of spaced-apart transversely extending bars secured to the side rails which extend therebetween, said mounting bracket assembly being selectively removably secured to said pair of the transversely extending bars.

8. The combination of claim 7 wherein the transversely extending bars are selectively movably secured to the side rails of the rack.

9. In combination with a vehicle having a plurality of tires, comprising:

a flat plate positioned on a supporting surface whereby one tire of the vehicle may be positioned thereon;

an elongated upstanding support pole extending upwardly from said flat plate and having upper and lower ends;

a first upstanding support selectively rotatably mounted on the upper end of said support pole;

said first upstanding support being selectively adjustable so that it may be positioned in a substantially vertically disposed position regardless of the attitude of said support pole;

and an adjustable satellite dish mounted on said first upstanding support which may be adjusted with respect to said first upstanding support so as to receive signals from a satellite.

10. The combination of claim 9 wherein said satellite dish is selectively rotatably secured to said first upstanding support.

11. In combination with a table having opposite side edges, comprising:

a mounting bracket assembly selectively removably secured to the side edges of the table and extending therebetween;

a first upstanding support secured to said mounting bracket assembly;

said first upstanding support being selectively adjustable so that it may be positioned in a substantially vertically disposed position regardless of the attitude of the table and an adjustable satellite dish mounted on said first upstanding support which may be adjusted with respect to said first support so as to receive signals from a satellite.

12. The combination of claim 11 wherein said satellite dish is selectively rotatably secured to said first support.

* * * * *